United States Patent [19]

Dussault et al.

[11] 4,064,885

[45] Dec. 27, 1977

[54] APPARATUS FOR CLEANING WORKPIECES BY ULTRASONIC ENERGY

[75] Inventors: Jean G. M. Dussault, Naugatuck; Robert A. Geckle, Newtown; William L. Puskas, Trumbull, all of Conn.

[73] Assignee: Branson Ultrasonics Corporation, New Canaan, Conn.

[21] Appl. No.: 735,601

[22] Filed: Oct. 26, 1976

[51] Int. Cl.[2] ..... B08B 3/02

[52] U.S. Cl. ..... 134/58 R; 134/148; 134/149; 134/184

[58] Field of Search ..... 134/1, 58 R, 140, 147–149, 134/153, 184; 259/DIG. 44

[56] References Cited

U.S. PATENT DOCUMENTS

| | | | |
|---|---|---|---|
| 2,850,854 | 9/1958 | Levy | 134/1 U |
| 2,938,732 | 5/1960 | Mantell, Jr. | 134/149 X |
| 2,994,329 | 8/1961 | Catlin et al. | 134/58 R |
| 3,401,708 | 9/1968 | Henes | 134/1 X |
| 3,829,328 | 8/1974 | Blustain | 134/1 |

FOREIGN PATENT DOCUMENTS

| | | | |
|---|---|---|---|
| 2,019,784 | 7/1970 | France | 134/1 |

OTHER PUBLICATIONS

Jensen, E. W., "Polishing Silicon Wafers", *Geoscience Instruments Corp.*, 1966, pp. 1, 2, 9.

*Primary Examiner*—Robert L. Bleutge
*Attorney, Agent, or Firm*—Ervin B. Steinberg; Philip J. Feig

[57] ABSTRACT

A delicate workpiece, such as a semiconductor wafer is cleaned by supporting the workpiece on a shaft which is rotated. A film of liquid solvent is caused to continuously flow across the exposed workpiece surface while the workpiece is in rotation and ultrasonic energy is applied to the liquid film for causing cavitation in the solvent, thereby effecting cleaning of the workpiece surface. Upon shutting off the solvent and the ultrasonic energy, the workpiece is dried by spinning it at high speed.

13 Claims, 3 Drawing Figures

APPARATUS FOR CLEANING WORKPIECES BY ULTRASONIC ENERGY

BRIEF SUMMARY OF THE INVENTION

This invention concerns cleaning workpieces by ultrasonic energy and, more specifically, has reference to cleaning by ultrasonic energy delicate flat workpieces, such as semiconductor wafers, used in the manufacture of electronic integrated circuits. The use of ultrasonic energy in conjunction with a solvent for cleaning workpieces is well established in the art. Cleaning apparatus of this type have been described, for instance, in U.S. Pat. No. 2,845,077, dated July 29, 1958; U.S. Pat. No. 3,293,456, dated Dec. 20, 1966; No. 3,318,578, dated May 9, 1967; U.S. Pat. No. 3,651,352, dated Mar. 21, 1972; and in "Ultrasonic Engineering" (book), John Wiley & Sons, New York, N.Y. (1965), pp. 130 to 143.

In typical prior art devices, a metal container or tank is filled with a suitable solvent and the workpiece to be cleaned is immersed in the solvent. The container or tank is provided with one or more ultrasonic transducers which responsive to energization with high frequency energy, produce cavitation in the solvent which action scrubs the workpiece clean by dislodging and removing contaminants adhering to the workpiece surface. Such cleaning occurs also in normally hidden recesses along the workpiece surface. For instance, when cleaning medical instruments, cleaning is achieved in crevices and between overlapping hinged portions. The solvent is selected depending upon the contaminant and such solvents may comprise aqueous or fluorocarbon solutions and the like, all as is known to those skilled in the art.

The present invention is particularly suited for cleaning delicate workpieces, specifically flat wafer like objects which require a high degree of cleanliness. As stated heretofore, this applies quite specifically to semiconductor wafers which are processed to produce highly complex integrated circuits used in the electronic industry. These wafers must not only be free from contaminants and fingerprints, but also all traces of the solvent must be removed after cleaning. In the past, the wafer has been placed on a rotating shaft so that the wafer rotates in an horizontal plane. As the wafer rotates, the top surface of the wafer to be cleaned is wetted with a suitable solvent and a scrubbing brush is caused to engage the top surface to dislodge contaminants and provide a cleaned surface. It will be apparent that such physical scrubbing by bristles is undesireable, especially when cleaning articles of the type described, since such brushing may cause physical damage to the surface, for instance, scratches resulting from contact with the bristles. Moreover, the brushes may become charged with hard foreign material which subsequently scratches the workpiece surface. Finally, the brush is subject to wear and may need to be replaced without such replacement being done by operating personnel, thereby producing insufficiently cleaned workpieces. While in some applications the brush is replaced by an abrasive cloth, substantially the same disadvantages remain. Various still further disadvantages of cleaning by mechanical friction processes will readily be apparent to those skilled in the art.

In the present invention, the mechanical contact scrubbing of the wafer is replaced by ultrasonic cleaning which provides cleaning of the workpiece without physical contact.

To this end, the workpiece to be cleaned, in accordance with the present invention, is rotated upon a shaft and a relatively thin film of solvent is caused to overflow the surface of the workpiece while ultrasonic energy is applied to the liquid film. The ultrasonic energy applied to the solvent causes intense cleaning of the workpiece surface and dislodging of contaminants and debris, the latter being flushed by the flowing solvent film. When a clean surface has been attained, the flow of solvent is shut off and the shaft is rotated at a high speed, causing the workpiece to spin for effecting drying of the workpiece by centrifugal force. The dry and clean workpiece is then removed from the shaft and processed further. This method overcomes the shortcomings and disadvantages of the prior art.

One of the principal objects of this invention is therefore the provision of a new and improved apparatus for cleaning delicate workpieces.

Another object of this invention is the provision of a new apparatus for cleaning delicate, wafer like workpieces by ultrasonic energy.

Another important object of this invention is the provision of a new apparatus for cleaning delicate flat workpieces utilizing a flowing film of solvent overlying the workpiece surface to be cleaned, and the use of ultrasonic energy coupled through such film to the workpiece surface for dislodging contaminants adhering to the workpieces surface.

A further object of this invention is the provision of a apparatus for efficiently cleaning flat semiconductor wafers as used in the electronics industry, the cleaning being accomplished without mechanical scrubbing or engagement of the workpiece surface.

Further and still other objects of this invention will be more clearly apparent by reference to the following description when taken in conjunction with the accompanying drawings.

DETAILED DESCRIPTION OF THE INVENTION

Figure 1:
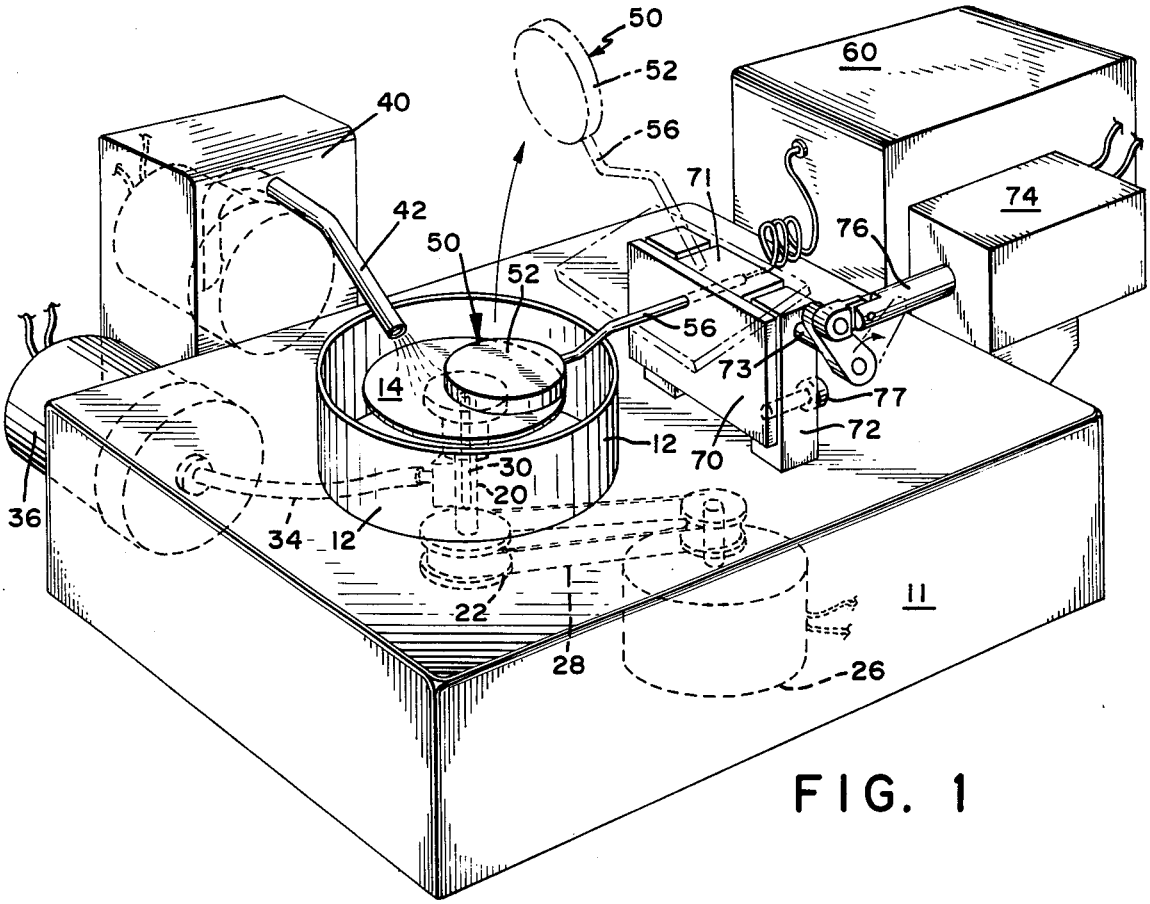
FIG. 1 is a perspective view of a typical embodiment of the present apparatus.
Figure 2:
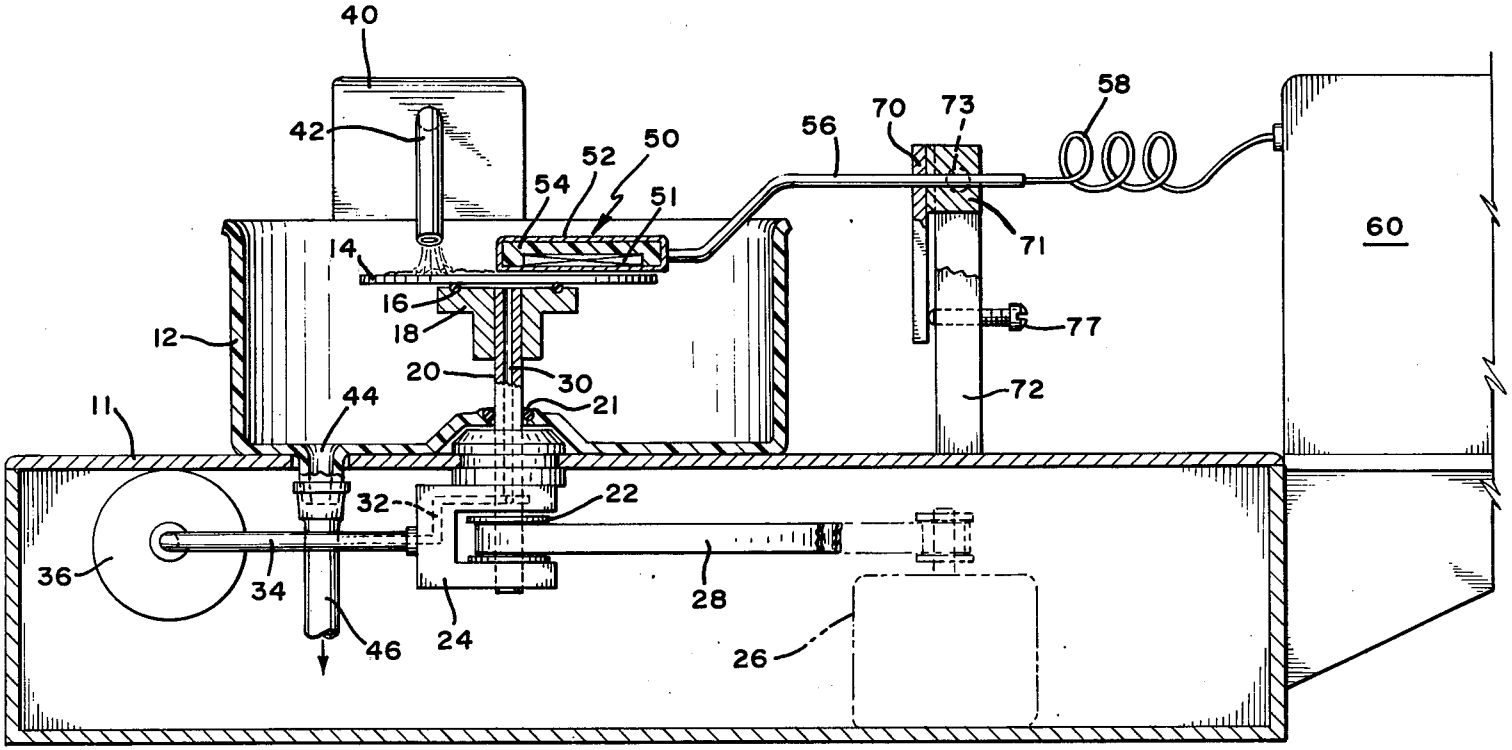
FIG. 2 is an elevational view, partly in section, of the apparatus shown in FIG. 1.

Referring now to the figures and FIGS. 1 and 2 in particular, there is shown a stationary support 11 which supports an open vessel 12. A workpiece 14 to be cleaned is disposed in a horizontal plane and rests with its underside on an O-ring gasket 16 which is disposed in an annular groove of a bushing 18. The bushing 18 is fitted upon a rotatable shaft 20 which is sealed liquid tight with vessel 12 by means of a gasket 21. The shaft is fitted at its lower end with a pulley 22 and is journalled in a U-shaped housing 24. A motor 26 via a belt 28 is adapted to rotate the shaft 20 and, hence, the workpiece 14 resting upon gasket 16 of bushing 18. It will be apparent later that the motor 26, in the preferred example, is a two-speed motor.

The shaft 20 is provided also with an internal bore 30 which leads to a similar bore 32 in the housing 24, to a hose 34 and to a vacuum pump 36. By operating the vacuum pump 36, the wafer 14 is held against the bushing 18, thereby avoiding mechanical clamping means which would have to engage the rim or the top surface of the wafer 14 to retain the workpiece 14 upon the shaft 20 during its rotation.

Suitably selected solvent is dispensed from a pump 40 via conduit 42 upon the exposed top surface of the workpiece 14 and after the solvent flows over the surface, it is collected in a drain 44 of the vessel 12, fed to drain hose 46, and is returned to the pump 40 for recirculation. For the sake of simplicity, a separate solvent reservoir and filter have not been shown.

The above described arrangement is a fairly standard unit, its component being incorporated in a scrubber device manufactured by Macronetics Corporation of Sunnyvale, Calif. It will be apparent that the described mechanical items can take various other shapes and forms and may be constructed in different embodiments as is well within the skill of persons working in the respective art.

Referring still to FIGS. 1 and 2, there is shown a flat, electroacoustic transducer means 50 comprising in the preferred example, a piezoelectric wafer 51 of circular shape contained within a metal housing 52. The space between the piezoelectric wafer 51 and the housing 52 is filled by epoxy resin 54 as is well known in the construction of ultrasonic transducers. The housing 52 is mounted to a tubing 56 which contains internally a pair of electrical conductors 58 for providing electrical high frequency energy from a generator 60 to the piezoelectric wafer 51. In a typical example, the piezoelectric wafer 51 is dimensioned to be energized with a frequency of 70 kHz which renders the piezoelectric wafer resonant. It will be apparent that, depending on the dimensions of the piezoelectric wafer, other frequencies will be required to cause the transducer means 50 to become resonant, but generally a a frequency in the range from 20 kHz to 100 kHz will be the preferred range. The tubing 56 is mounted through a plate 70 and to a block 71 which is pivotally coupled via pin 73 to a stationary structure 72. Responsive to the energizing of a solenoid 74, a linkage mechanism 76 causes the transducer means 50 to swing upward and assume the position shown by the dashed lines in FIG. 1. A screw 77 adapted to contact the plate 70 stops the downward motion of the transducer means 50 when the solenoid is deenergized and thereby regulates the spacing between the front face of the ultrasonic transducer means and the surface of the workpiece 14. In order to obtain optimum cleaning results, the surface of the transducer means should be in parallel alignment with the flat workpiece surface.

DESCRIPTION OF THE OPERATION

Operation of the present apparatus may be visualized by the following description.

Figure 3:
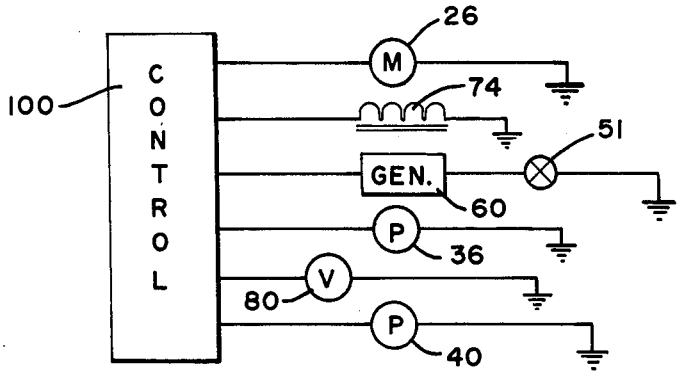
FIG. 3 is a schematic electrical circuit diagram showing the operation of the various components forming the electrical circuit.

With the solenoid 74, see also FIG. 3, energized causing the transducer means 50 to be in the raised position, a wafer 14 to be cleaned is placed on the bushing 18. Next, the vacuum pump 36 is energized for causing a vacuum to be pulled in the bore 30, thereby retaining the workpiece on the shaft 20. Next, the motor 26 is energized at its low speed, typically at 100 rpm, causing the workpiece 14 to rotate. Too high a rotational speed produces excessive tangential velocity upon the solvent accompanied by poor cleaning results. Upon rotation of the wafer 14, the solvent pump 40 is actuated and a valve 80 disposed in the solvent conduit, not shown in FIGS. 1 and 2, is opened thereby permitting solvent to flow from conduit 42 in a film across the top surface of the rotating workpiece 14. Next, the transducer means 50 is lowered to be disposed above the workpiece 14 by deenergizing the solenoid 74. With the liquid film overflowing the workpiece surface, the electrical high frequency generator 60 is energized causing the transducer element 51 to be resonant and produce cavitation in the relatively thin solvent film flowing continuously across the workpiece surface. Preferably, the solvent film is relatively thin, typically 0.040 inch (1 mm) or less. A thicker film up to ¼ inch (6 mm) is acceptable also except that a greater amount of ultrasonic energy will be required. It will be apparent that the thinner the film, the more ultrasonic energy reaches the workpiece surface and the lower the power requirement. As the ultrasonic energy dislodges the contaminants from the workpiece surface, the flowing film removes the contamination and debris from the workpiece surface. Moreover, as the wafer rotates all surface portions of the wafer become exposed to the ultrasonic energy and the transducer does not need to be of the same diameter as the wafer, it being of slightly larger diameter than the radius of the circular workpiece.

After cleaning has been accomplished, typically a period from five to 30 seconds, the pump 40 is shut off and valve 80 closed. This shuts off solvent flow. Also the generator 60 is shut off at this time and most suitably the solenoid 74 is energized in order to raise the transducer means away from the workpiece 14. Next, the motor 26 is turned to its high speed, for instance 5,000 rpm, causing rapid spinning of the workpiece to cause solvent overlying the workpiece surfaces to become driven off by centrifugal force. After this drying action has been completed, typically a period of only 10 seconds, the motor 26 is stopped and the vacuum pump 36 is stopped. When the workpiece stands still and the vacuum has been dissipated by itself or an additional vacuum bleed valve, not shown, has been actuated the workpiece 14 is removed from the apparatus which now is ready for the receipt of a new workpiece.

The sequencing described heretofore, as will be apparent to those skilled in the art, can be accomplished manually, but if desired a control device 100, in the form of a simple cam operated motor driven timing device, may be substituted. Moreover, the sequence described above can be varied to some extent without affecting the cleaning process. For instance, a rinse cycle during which water flows across the wafer to remove solvent residue may be added prior to drying.

It should be noted that the effective cleaning action is caused primarily by the combination of a thin flowing film of solvent to which ultrasonic energy is applied while the workpiece is in motion. Due to the combination of this cleaning action in conjunction with spin drying, manual contact with the workpiece is avoided, thus providing superior results and precluding surface scratches and other materials to be introduced upon the delicate workpiece surface as is detrimental when the workpiece becomes a part of a delicate electronic circuit product.

In an alternative embodiment, the transducer means 50 is made to be substantially of the same diameter or of a larger diameter than the wafer 14 for covering the entire surface. The wafer then is cleaned while stationary with cleaning solvent supplied to the space between the transducer means and the wafer surface. As described, the wafer is rotated for spin drying, thus requiring only a single-speed motor 26.

While the above described embodiment shows a recirculation arrangement for the cleaning solvent, it is apparent that the surface of the wafer may be flushed with solvent which subsequently is drained from the apparatus.

While there has been described and illustrated a specific embodiment of the present invention and several modifications have been indicated, it will be apparent to those skilled in the art that various changes and modifications may be made therein without deviating from the broad principle and spirit of the present invention which shall be limited only by the scope of the appended claims.

What is claimed is:

1. Apparatus for cleaning a workpiece, such as a semiconductor wafer, comprising:

a rotatable support including means for holding a workpiece on said support;

means coupled to said support for rotating said support to cause a workpiece disposed on said support to undergo rotation;

means for flooding the exposed side of the workpiece with a flowing film of cleaning solvent;

mounting means disposed for supporting electroacoustic transducer means opposite said exposed side;

electroacoustic transducer means coupled to said mounting means for providing, when said transducer means is energized, ultrasonic energy to said flowing film of solvent and causing cavitation therein for cleaning said exposed workpiece side;

electrical generating means coupled for energizing said transducer means, and control means coupled to said means for rotating, said means for flooding and said electrical generating means for providing operation of said respective means in predetermined sequence.

2. Apparatus for cleaning as set forth in claim 1, said means for holding comprising vacuum means.

3. Apparatus for cleaning as set forth in claim 1, said means coupled to said support for rotating said support adapted to rotate said support at a first speed when said transducer means is energized and at a second speed when said means for flooding is not operated.

4. Apparatus for cleaning as set forth in claim 1, said support being constructed to hold the exposed workpiece side in a substantially horizontal plane.

5. Apparatus for cleaning as set forth in claim 1, and means disposed for draining the solvent after flowing over the exposed workpiece side and recirculating it.

6. Apparatus for cleaning as set forth in claim 1, said transducer means being enclosed in a metallic housing.

7. Apparatus for cleaning as set forth in claim 1, said transducer means being adapted to operate at a frequency in the range from 20 to 100 kHz.

8. Apparatus for cleaning as set forth in claim 1, said mounting means disposed for supporting said transducer means including motion means for moving said transducer means from a position opposite said exposed side to a position free from said exposed side.

9. Apparatus for cleaning as set forth in claim 8, said motion means including pivotable means and actuating means coupled to said pivotable means.

10. Apparatus for cleaning as set forth in claim 1, the thickness of said film of cleaning solvent being less than six mm.

11. Apparatus for cleaning as set forth in claim 1, said control means comprising automatic sequencing means.

12. Apparatus for cleaning as set forth in claim 1, the spacing between said exposed side of the workpiece and said transducer means being substantially uniform.

13. Apparatus for cleaning a workpiece, such as a semiconductor wafer, comprising:

a rotatable support including means for holding a workpiece on said support;

means for flooding the exposed side of the workpiece with a flowing film of cleaning solvent;

mounting means disposed for supporting electroacoustic transducer means opposite said exposed side;

electroacoustic transducer means coupled to said mounting means for providing, when said transducer means is energized, ultrasonic energy to said flowing film of solvent and causing cavitation therein for cleaning said exposed workpiece side;

electrical generating means coupled for energizing said transducer means;

means coupled to said support for rotating said support at a speed sufficient to effect solvent removal from the exposed workpiece side by centrifugal force, and control means coupled to said means for flooding, said electrical generating means and said means for rotating for providing operation of said respective means in predetermined sequence.

* * * * *